US005209856A

United States Patent [19]

Cuel et al.

[11] Patent Number: 5,209,856

[45] Date of Patent: May 11, 1993

[54] PROCESS AND DEVICE FOR CONTINUOUS CRYSTALLIZATION OF A MASSECUITE

[75] Inventors: Jacques Cuel, Paris; Claude Longue-Epee, La Neuville, both of France

[73] Assignee: Beghin-Say, S.A., Paris, France

[21] Appl. No.: 588,472

[22] Filed: Sep. 26, 1990

Related U.S. Application Data

[63] Continuation of Ser. No. 858,034, May 1, 1986, abandoned, which is a continuation of Ser. No. 625,830, Jun. 18, 1984, abandoned.

[30] Foreign Application Priority Data

Oct. 18, 1982 [FR] France ..... 82 17408

[51] Int. Cl.[5] ..... C13F 1/06; C13F 1/12

[52] U.S. Cl. ..... 210/774; 127/15; 127/56; 127/62; 210/182; 210/195.1; 210/259; 210/787; 210/805; 210/806; 210/808; 366/134; 366/136

[58] Field of Search ..... 127/15, 16, 58, 60, 127/61, 62, 17-19, 56; 210/787, 360.1, 197, 805, 182, 195.1, 259, 774, 806, 808; 366/136, 137, 139, 134

[56] References Cited

U.S. PATENT DOCUMENTS

| | | | |
|---|---|---|---|
| 1,844,020 | 2/1932 | Spreckels | 127/61 X |
| 2,032,160 | 2/1936 | Widmer | 127/62 |
| 2,129,864 | 9/1938 | Newkirk | 127/62 |
| 3,356,532 | 12/1967 | Grandadam | 127/62 |
| 4,009,045 | 2/1977 | Petri | 127/19 |

FOREIGN PATENT DOCUMENTS

| | | |
|---|---|---|
| 611094 | 9/1926 | France . |
| 1528738 | 6/1968 | France . |
| 2064277 | 7/1971 | France . |
| 2402460 | 4/1979 | France . |

*Primary Examiner*—Joseph W. Drodge
*Attorney, Agent, or Firm*—Breiner & Breiner

[57] ABSTRACT

A process and device for the crystallization of sugar syrup is described. Sugar syrup is cooked to provide a massecuite. Thereafter, the massecuite is subjected to at least one stage of continuous mixing under vacuum to promote crystallization of the massecuite. The crystallized massecuite is then separated to separate the crystals from the mother liquor. The mother liquor is thereafter divided into a first discharge which is water syrup poor and a second discharge which is water syrup rich. Substantially all of the first discharge is recycled to the continuous mixing stage under vacuum. Accordingly, the massecuite and the crystals are subjected to a treatment having continuity during mixing under vacuum to maintain homogeneity of the sugar crystals.

16 Claims, 4 Drawing Sheets

PROCESS AND DEVICE FOR CONTINUOUS CRYSTALLIZATION OF A MASSECUITE

This is a continuation of co-pending application Ser. No. 06/858,034 filed on May 1, 1986, which in turn is a continuation of application Ser. No. 06/625,830 filed Jun. 18, 1984, now abandoned.

The present invention relates to a process and a device for continuous mixing of a massecuite obtained particularly during the manufacture of sugar, it being understood that "sugar" is understood to mean "sucrose."

The processes for the extraction of sugar rely, in general, on two kinds of factories: factories for manufacture as such (sugar mills) and factories for after-treatment (refineries) in which the sugars are refined, filtered, crystallized and formed. The sugar mills have equipment which is adapted to the raw material employed which is sugar beet or cane. Thus, sugar mills have specific equipment while the refineries process raw sugars, whether they be from cane or from sugar beet.

When the raw material is sugar beet, a diffusion process is employed to obtain a juice which will have collected the sugar contained in the sugar beet, which is first cut up into thin strips or cossettes. In general terms, the diffusers are devices in which water is circulated countercurrentwise. The juices which are obtained contain approximately 11 to 12% of impurities, calculated on the dry materials. A treatment with lime followed by a carbonation and a separation by filtering or decanting permits a satisfactory purification from organic non-sugars.

When the raw material is cane, the operation involves crushing and pressing in "mills" to extract the juice, rarely involving diffusion. Since it does not contain the same impurities as the sugar beet juice, the cane juice undergoes a different purification and the carbonation stage is eliminated.

On the other hand, insofar as the crystallization stages are concerned, the required operations are comparable in both kinds of sugar mill.

The present invention relates more particularly to the stages permitting the sugar to be crystallized and applies to all the sugar juices, whatever the raw material employed.

The crystallization at the mill (for cane or beet) and at the refinery (for cane or beet) is aimed at extracting in a crystallized form, with as high a yield as possible, the sugar dissolved in the syrup and thus to separate it from the soluble impurities which accompany it. The rate of crystallization depends principally on the following inter-related parameters: supersaturation, viscosity, temperature, internal agitation, purity and pH.

French Patent No. 1,528,738 describes a process for the crystallization of sugar mill syrup according to which concentrated sugared juices wherein a fraction of the sugar is crystallized are introduced into a boiler. The massecuite obtained is mixed for a time at an elevated temperature and then is screened in a centrifugal separator of liquid where the crystals are separated from the syrup. The mother discharge is then mixed with crystals and then undergoes a second mixing in order to induce the crystallization of the sugar contained in the said discharge.

In this process, the fact that the operation takes place at an elevated temperature, which is essential on account of its characteristics, does not permit a sufficiently high degree of crystallization to be reached. Moreover, the consumption of energy is high.

French Patent No. 2,064,277 describes a process for producing crystals continuously according to which a sugar syrup, in the presence of previously added crystalline seeds, is concentrated under vacuum in a crystallizer having several successive compartments. This process requires a relatively high temperature, which, on the one hand, increases the energy cost and, on the other hand, reduces the crystallization yield.

The crystallization process according to the invention makes it possible to obtain immediately after the end of the mixing of the massecuite a much more substantial quantity of crystallized sugar than when the processes which are known at present are employed. In fact, the process aims at a maximum lowering of the temperature of the massecuite to increase the crystallization. It consists in subjecting a sugar syrup to a continuous or non-continuous boiling so as to obtain a massecuite, in subjecting the massecuite to one or more stages of continuous mixing under vacuum, then in separating the crystals from the mother liquor of the crystallization stream in question, particularly centrifugal turbine action, and is characterized in that at least a part of the mother liquor is recycled during the stages of mixing under vacuum. Another subject of the invention is a device for mixing a massecuite, consisting of one or more mixers arranged in series, comprising inlet and outlet means for the massecuite, and at least one vacuum pick-off, characterized in that the mixer or mixers comprise an inlet means for the mother liquor obtained during the removal of liquid of the crystallized massecuite. Preferably, only the part called "low-content discharge" is recycled during the vacuum mixing stages. The part called "high-content discharge" is reinjected, for example, at the boiling stage. The terms "low-content discharge" and "highcontent discharge" are defined according to J. Dubourg, Sucreries de betteraves (Sugar manufacture from sugar beet) 1952, respectively as "egout pauvre" and "egout riche." Also preferably, the recycled part of the mother liquor is reheated and de-emulsified before the said recycling. Although the viscosity of the massecuite increases, the lowering in temperature is made possible by the vacuum self-evaporation, in a continuous process, of the water contained in the massecuite and by the recycling of all or a part of the mother liquor, which thereby produces a violent and continual agitation. This agitation is all the more efficient because it takes place in a regular manner in a thin and uniform layer of the massecuite.

It is advantageous that the continuous vacuum mixing comprises several successive stages. In the case of two stages, the first is operated under a vacuum between 82.6 MPa and 88.0 MPa, the second under a vacuum between 88.0 MPa and 96.0 MPa. The massecuite must have an initial temperature of approximately 80° C. and, at the outlet from the continuous vacuum mixing its temperature should have decreased to a value between 40° C. and 50° C. The crystallized massecuite is then turbine-centrifuged to remove liquid: the crystals are separated from the mother liquor and the low-content discharge from the crystallization stream in question is recycled, for the most part, in the region of the continuous vacuum mixer or mixers. The recycled low-content discharge maintains a sufficient fluidity so that the massecuite does not set and that the mobility of the crystals allows them to move. Preferably, the inlet means of the low-content discharge consist of one or more pipes situated in the lower part of the cylinder. Preferably, these pipes arrive at the cylinder tangentially. Preferably, their number is between two and ten.

The process and the device according to the invention will be better understood by virtue of the description of FIGS. 1, 2, 3, 4, 5 and 6, and by virtue of an example of embodiment.

Figure 2:
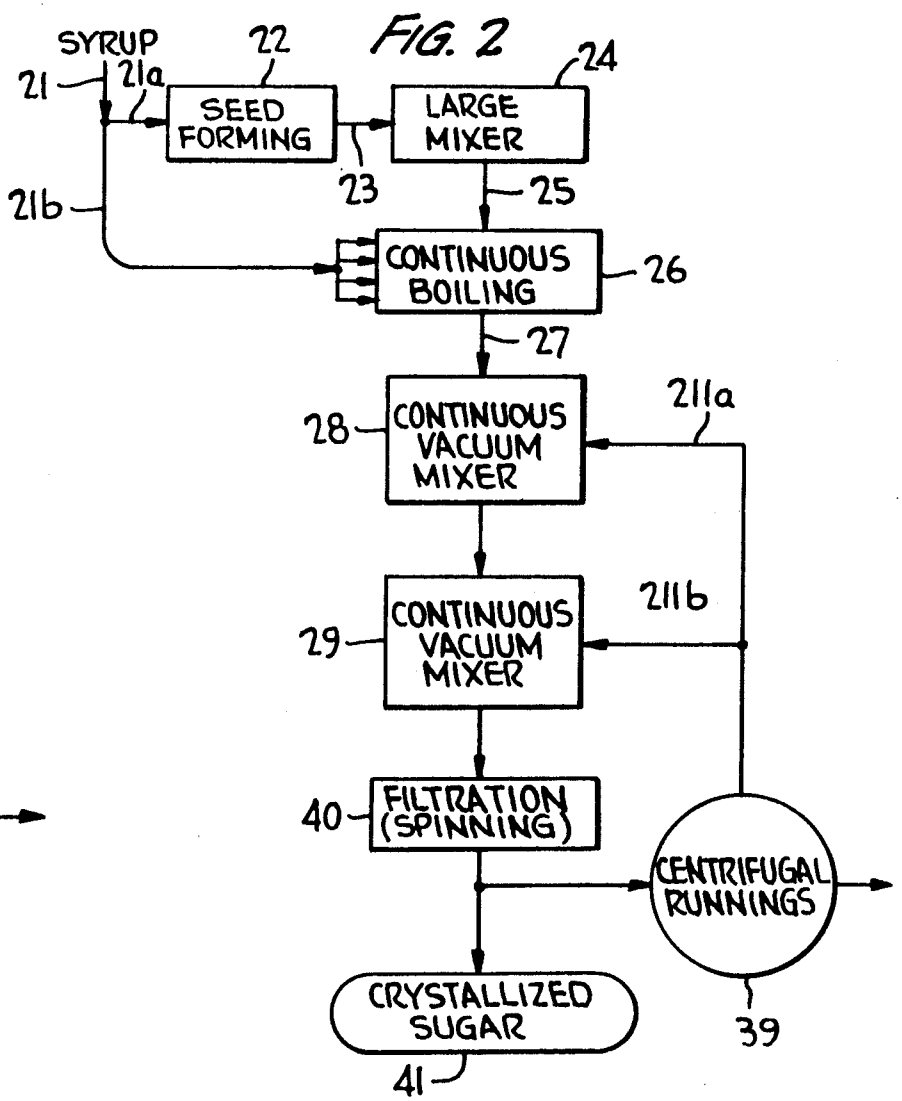
FIG. 2 shows a flow-sheet of a preferred variation of the process according to which, after continuous boiling, the continuous vacuum mixing is carried out in a device consisting of two separate mixers.

According to FIGS. 1, 2, 3 and 4, a fraction la, 21*a* of the sugar syrup 1, 21 is directed to a vertical device 2, 22 to form the boiling foot. The device has a volume of 300 hectolitres and comprises a calandria, with tubes supported by two plates of a frustoconical shape, sloping towards the central well equipped with a propeller stirrer.

The boiler feet 3, 23 of the vertical device 2, 22 supply the magma (large) mixer 4, 24.

The magma mixer is a completely closed cylindrical horizontal capacity, fitted with an agitator consisting of a helix supported by a longitudinal shaft turning at 1 rpm and equipped with a double jacket for the circulation of hot water at 80° C. enabling the whole to be controlled at constant temperature; this magma mixer acts only as buffer storage. The magma 5, 25 travelling from the mixer 4, 24 and the fraction 1*b*, 21*b* of the sugar syrup supply the continuous boiling device 6, 26.

The continuous boiling device 6, 26 consists of a cylindrical horizontal vessel, made of steel, inside which heating is supplied by a bundle of longitudinal tubes of stainless steel, arranged in layers. The lower part of the vessel is provided with a double jacket in which circulate the vapors which are not condensed in the bundle. Steam is injected at a certain flow-rate into the lower part of the device for boiling, to provide agitation of the massecuite. The device is divided into compartments by transversal partitions and a longitudinal partition at the base of which an orifice permits the forward movement of the massecuite. The first compartment is supplied with the magma. The other compartments are supplied with the massecuite originating from the preceding compartment. Each compartment is also provided with a supply of syrup 1*b* or 21*b*, which flows through turning pipes into the continuous boiling device 6 or 26 containing the massecuite. The massecuite arriving at the last compartment is extracted at its base by a variable-speed pump. The circulation and the flow-rate of the fluids in the device are controlled by control channels for vacuum, steam pressures, agitation, density and massecuite level.

As an example, the main characteristics of a device for continuous boiling (constructed by Fives-Cail-Babcock) are as follows :

| | |
|---|---|
| Overall length | 9.0 m |
| Internal length | 7.4 m |
| Overall width | 3.5 m |
| Overall height | 4.1 m |
| Internal diameter of the shell | 3.1 m |
| Volume occupied by the massecuite | 32 $m^3$ |
| Total heating surface | 324 $m^2$ |
| Stainless tubes, length | 7.5 m |
| Total number of tubes | 464 |
| Test pressure of the bundle | 2 bars |
| Empty weight | 32 tons |
| Operating weight | 77 tons |
| Number of compartments | 10 |

The operating conditions of the device described above are as follows:

| | |
|---|---|
| Boiler foot magma 3, 23: | |
| Brix | 86–88° |
| Purity | 99.0–99.5 |
| Rate | 6 to 7 tons/hour |
| Content of crystals | 30 to 40% |
| Average Opening of the crystals | 0.20 to 0.25 mm |
| Feed liquor lb, 2 lb.: | |
| Brix | 68–70° |
| Purity | 99.0–99.5 |
| Rate | 26 to 30 tons/hour |
| Massecuite 7, 27: | |
| Brix | 90–91° |
| Purity | 99.0–99.5 |
| Rate | 26 to 30 tons/hour |
| Content of crystals | 50 to 55% |
| Average Opening of the crystals | 0.5 to 0.6 mm |

(Brix being defined as the value of the ratio of the weight of dry matter/total weight of the syrup.)

The massecuite 7, 27 is moved towards a device for continuous mixing under vacuum 8, 28.

Figure 1:
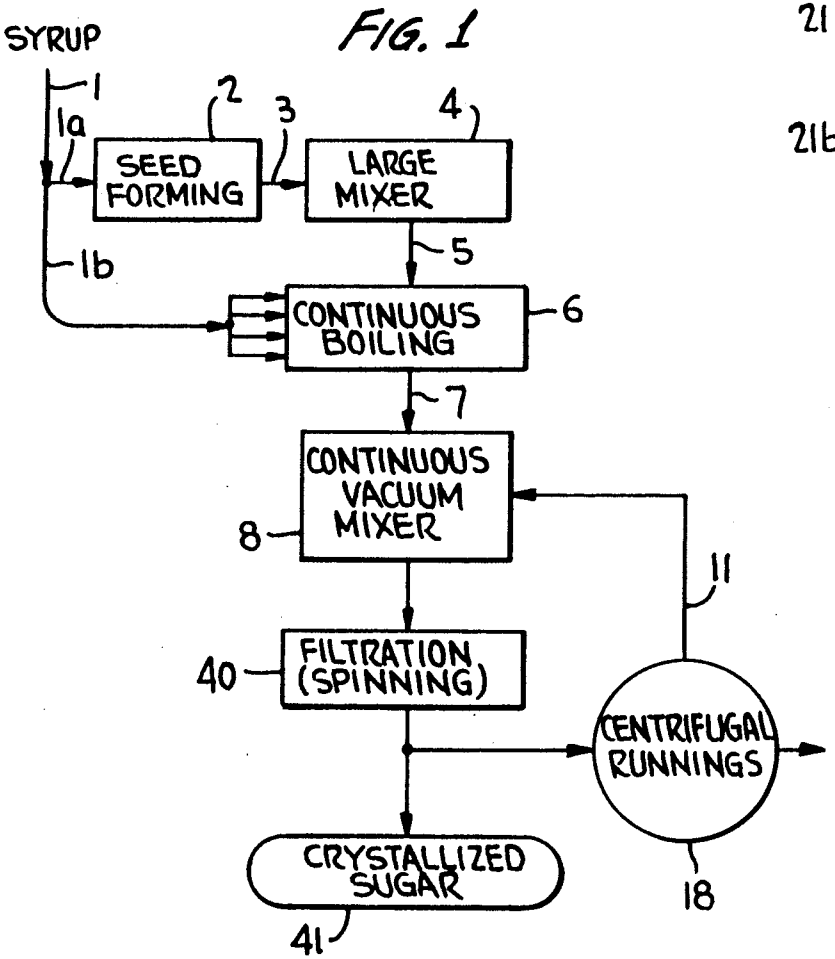
FIG. 1 shows a flow-sheet of a variation of the process according to which, after continuous boiling, the continuous vacuum mixing is carried out in a device consisting of a single mixer.
Figure 3:
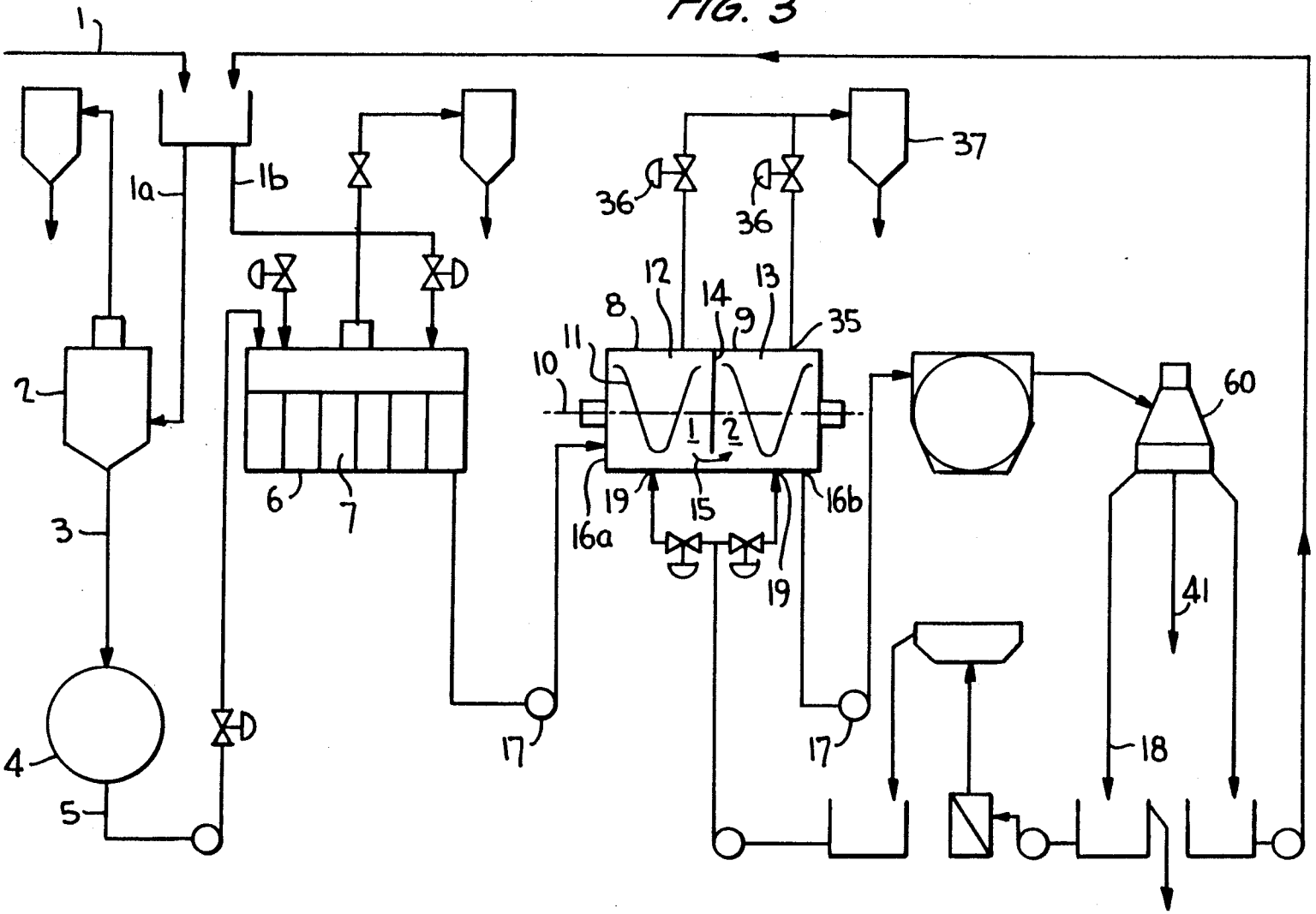
FIG. 3 shows the device for carrying out the process illustrated in FIG. 1.
Figure 4:
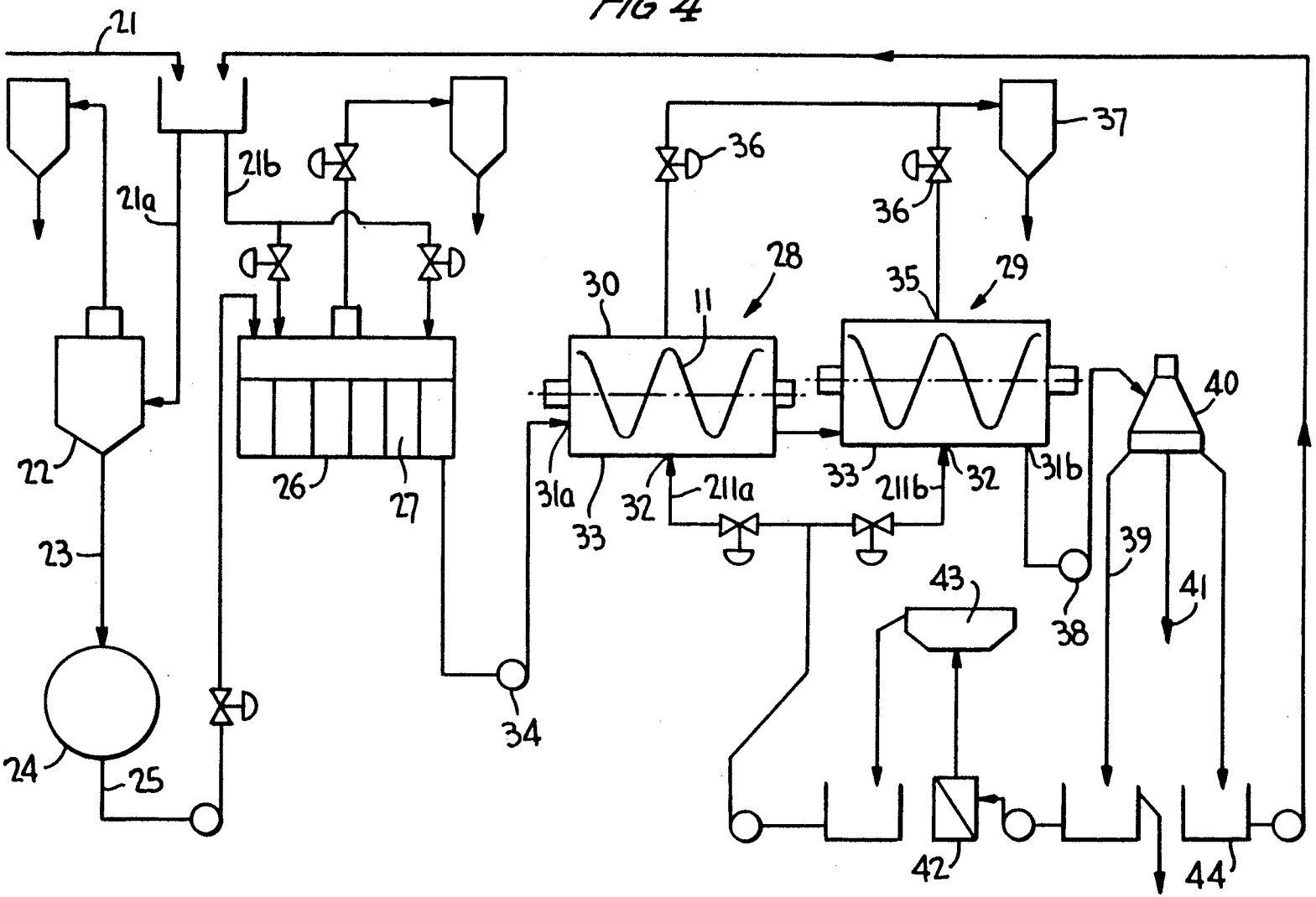
FIG. 4 shows the device for carrying out the process illustrated in FIG. 2.
Figure 5:
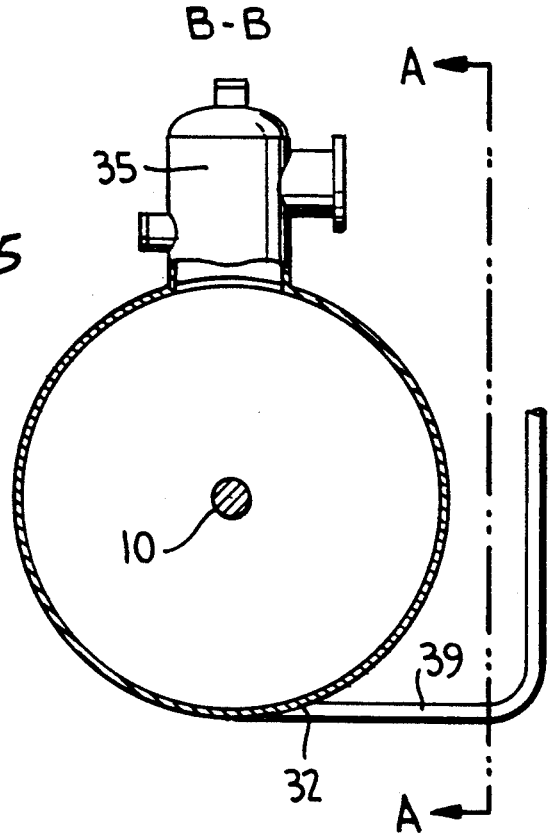
FIG. 5 is a transversal view in a cross-section which is broken in a parallel plane of a vacuum mixer illustrated in FIG. 4.
Figure 6:
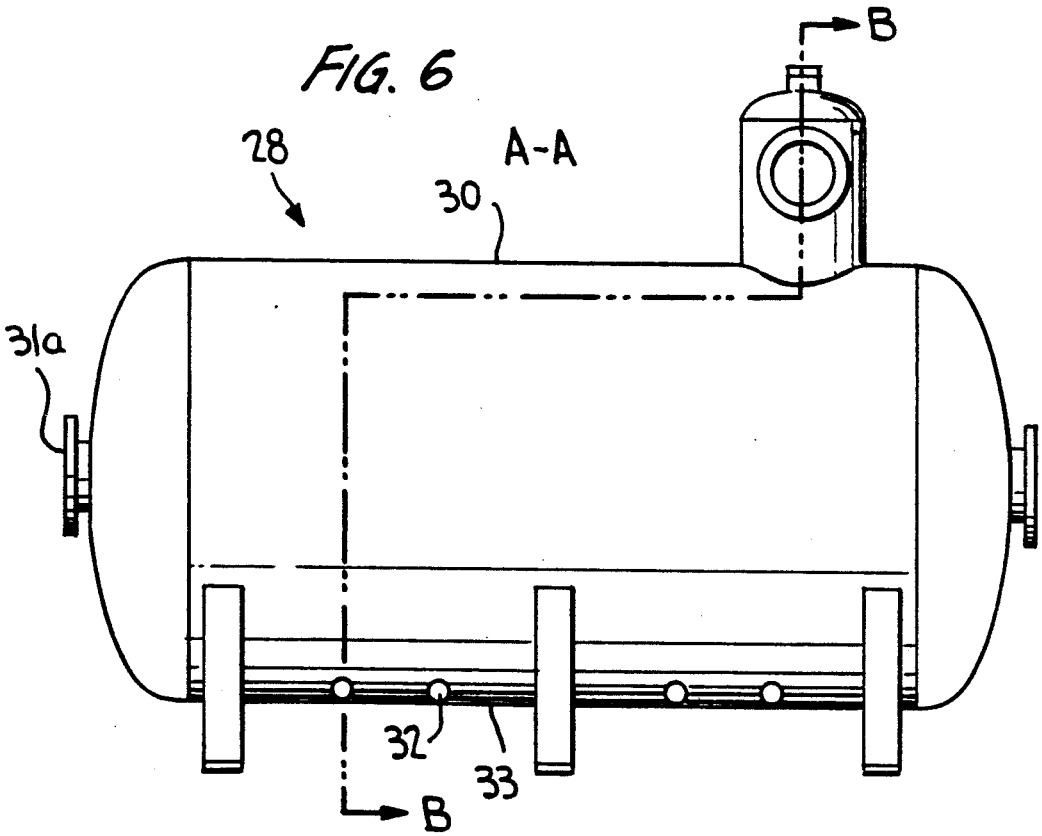
FIG. 6 is a view of the same mixer in profile along A.A.

According to a variation of the invention—FIGS. 1 and 3—this device consists of a mixer 8 comprising an hermetic, thermally insulated, horizontal shell 9, fitted with a longitudinal shaft 10 supporting a helix 11 and divided into two-compartments 12, 13 by a leaktight wall 14 which is equipped in it slow part with an orifice 15 permitting the transfer of the massecuite from an inlet compartment to the outlet compartment, each compartment being provided with a tubing 35 permitting a connection to a source of vacuum. The inlet compartment and the outlet compartment are respectively provided with inlet tubings 16*a* and outlet tubings 16*b* of the massecuite, these tubings being of small cross-section and situated in the low part of each compartment. As an example, the first compartment is subjected to a vacuum of 82.2 MPa, and the second to a vacuum of 89.4 MPa. The arrival and departure of the massecuite take place through the low part of the mixer with the aid, respectively, of a variable-speed positive displacement vacuum pump—which can be the extraction pump for the continuous boiling 6—and a variable speed positive displacement vacuum extraction pump. As the growth of the crystals takes place, fluidification of the massecuite is produced with the low-content discharge 18 obtained when the crystallized massecuite is rid of liquid (centrifuging stage 40 permitting the crystallized sugar 41 to be isolated). This low-content discharge is delivered to the bottom part of each of the compartments 12, 13 by three tangential tubings 19, the flow-rates therein being controlled.

According to a preferred variation of the invention—FIGS. 2, 4, 5 and 6—the two successive mixing stages are carried out in two continuous vacuum mixers 28, 29, with a single compartment, and mounted in series. The crystallized massecuite 27 leaving the first continuous vacuum mixer 28 is sent to the second mixer 29.

Each mixer 28, 29 consists of a horizontal cylinder 30 fitted with a low-power internal movement scraping the walls and thus preventing the build-ups of sugar. It also comprises the inlet tubings 31*a* and the outlet tubings 31*b* of the massecuite, of a small cross-section and situated in its lower part. The massecuite level is maintained essentially in the plane of the diameter, so as to offer the maximum surface area for evaporation. The fraction called "low-content discharge" 39, originating from the massecuite after liquidremoval 40, reheated 42 and de-emulsified 43 beforehand, is injected 211*a*, 211*b* into the mixers 28, 29 in four places through horizontal deliveries 32 distributed along the lower generatrix 33. The fraction called "high-content discharge" 44 is recycled with the fraction 21*b*. Each mixer 28, 29 forms a stage which is placed under a specified vacuum which corresponds to the required massecuite temperature. The stepwise change in the vacuum allows the lower limit of temperature to be reduced, while avoiding the spontaneous formation of "false grains." The whole system is continuously fed by a variable-speed positive displacement vacuum pump 34 from the outlet of a continuous boiling or of a charge mixer of a non-continuous boiling. Each stage is connected 35 to a high-vacuum station 37, the vacuum being regulated by means of an automatic valve 36. After a dwell time of 90 minutes, the cooled massecuite is continuously extracted by a variable-speed positive displacement vacuum pump 38. The speeds of the massecuite pumps are controlled by level-regulators. The vacua are regulated, at displayed set-points, by automatic valves. The rate of application of discharge to each stage is regulated proportionally to the flow-rate of massecuite and corrected in the last stage depending on the outlet Brix.

EXAMPLE 1

The characteristics of a device for continuous mixing under vacuum, formed by two separate continuous vacuum mixers are as follows:

| Mixer size | First | Second |
|---|---|---|
| Overall length | 7.25 m | 8.04 m |
| Internal length | 5.95 m | 6.15 m |
| Overall height | 3.0 m | 4.65 m |
| Internal diameter of the shell | 2.4 m | 2.90 m |
| Total volume | 250 hl | 373 hl |
| Working volume | 160 hl | 200 hl |
| Weight empty | 8.3 t | 12.9 t |
| Movement motor power | 2.2 kW | 4 kW |
| Vacuum station: | | |
| Vacuum pump giving 1,000 $m^3$/h at 96.0 MPa with 40 kW installed power. | | |
| Operation conditions for a first stage of refining: | | |
| Vacuum: | | |
| first stage | 85.3 MPa | |
| second stage | 95.3 MPa | |
| Massecuite temperatures: | | |
| first stage inlet | 82° C. | |
| first stage outlet | 60° C. | |
| second stage outlet | 40° C. | |

-continued

| | | |
|---|---|---|
| Characterstics of the massecuite entering: | | |
| Brix | 90.72° | |
| Rate | 16.23 | tons/hour |
| Crystals | 48.68% | /massecuite |
| | 53.66% | /dry matter |
| Characteristics of the massecuite leaving: | | |
| Brix | 86.76° | |
| Rate | 26.24 | tons/hour |
| Crystals | 49.60% | /massecuite |
| | 57.17% | /dry matter |
| Flow-rates of recycled discharges | 11.08 | tons/hour |
| Dimensions of the crystals: | | |
| Inlet average opening | 0.50 | mm |
| variation coefficient | 30 | |
| Outlet average opening | 0.60 | mm |
| variation coefficient | 27 | |
| Weight of crystals: | | |
| Inlet | 7.90 | tons/hour |
| Outlet | 13.01 | tons/hour |
| Growth | 1.65 | |

By comparison to a conventional process comprising boilings heated with steam, the process according to the invention permits approximately 60% of the steam consumption to be saved. In the example described, a significant growth of the crystals is observed, in excess of 60% for a first stage of refining.

The essential difference between the continuous vacuum mixer and the other types of crystallizer is that the cooling does not take place by an exchange with a fluid but by self-evaporation. The continuity of the operation favors the uniformity of the final product, which is obtained by maintaining the value of all the parameters of the control channels.

The "flash" which is produced at the input of the massecuite and the discharge which has previously been reheated and de-emulsified creates a turbulent state which facilitates the material transfers from the fluid to the crystal. The fact that the discharge is reheated—which introduces heat into the system—results in an additional crystallization of this discharge by self-evaporation.

Depending on the conditions of operation of the continuous vacuum mixing plant, the growth coefficient of the crystals is between 1.30 and 1.80. The crystallization process according to the invention can be called a "cold crystallization process": it eliminates all phenomena of recoloration of the massecuite, thereby reducing the quantity of water required in the washing stage, an operation which is always accompanied by a redissolution of the sugar crystals.

Thus, the process and the device for crystallization of a sugar syrup according to the invention permit the extraction to be raised to a level which has never been attained, whatever the technique employed. Furthermore, they confer on the mixing all the advantages of a continuous process, namely: steady operation—hence a better quality of the product obtained, a reduction in the size of the plant, a simplification of the control channels and of automation, and a very marked improvement in the operating cost of the plant.

We claim:

1. A process for crystallization of sugar syrup comprising subjecting said syrup to cooking to provide a massecuite; subjecting all of said massecuite to at least one stage of continuous mixing under vacuum so as to promote crystallization of said massecuite, subjecting all of said crystallized massecuite to a separation step so as to separate crystals from its mother liquor, dividing said mother liquor into a first discharge which is water syrup poor and a second discharge which is water syrup rich, and recycling substantially all of the first discharge to said stage of continuous mixing under vacuum; all of said massecuite and all of said crystals thereby being subjected to treatment having continuity during said mixing under vacuum so as to maintain homogeneity of the sugar crystals.

2. A process of the crystallization of a sugar syrup according to claim 1, characterized in that the recycled first discharge is reheated and de-emulsified before being returned to said at least one stage.

3. A process according to claim 1, characterized in that the continuous mixing of the massecuite under vacuum comprises a plurality of successive stages.

4. A process according to claim 3, characterized in that the plurality of successive stages of continuous mixing under vacuum are carried out in a single mixer.

5. A process according to claim 3, characterized in that each stage of continuous mixing under vacuum is carried out in a separate mixer.

6. A process according to claim 1, characterized in that the continuous mixing of the massecuite under vacuum comprises a first stage and a second stage which is successive to said first stage.

7. A process according to claim 6, characterized in that the first stage of mixing is conducted under a vacuum of between 82.6 and 88.0 MPa.

8. A process according to claim 6, characterized in that the second stage of mixing is conducted under a vacuum of between 88.0 and 96.0 MPa.

9. A process according to claim 1, characterized in that the massecuite following said cooking has a temperature in the region of 80° C.

10. A process according to claim 9, characterized in that the massecuite has a temperature between 40° C. and 50= C. at the end of said at least one stage of mixing under vacuum.

11. A process according to claim 1, characterized in that, the weight ratio between the weight of the massecuite following said cooking and the weight of said massecuite following said continuous mixing under vacuum is between 1.30 and 1.80.

12. The process of claim 1 wherein said separation step is by centrifugation of said crystallized massecuite.

13. A device for treating a massecuite to recover sugar crystals including a means for cooking a sugar syrup to provide a massecuite, at least one cylindrical mixer means for continuously mixing said massecuite having inlet means for receiving massecuite; outlet means for removing massecuite from said at least one mixer means, and at least one vacuum takeoff; and separator means for separation of all of the removed massecuite into crystals and water syrup poor and water syrup rich portions of mother liquor, said outlet means form said at least one mixer means being connected to said separation means, and additional means connecting said separator means and said at least one mixer means, said additional means being constructed and arranged to facilitate recycling of substantially all of said water syrup poor portion of mother liquor to said at least one cylindrical mixer means, said device being constructed and arranged so that all of the provided massecuite is subjected to treatment having a continuity with respect to continuous vacuum mixing in said at least one mixer means and separation by said separator means so as to maintain homogeneity of resulting sugar crystals.

14. A device according to claim 13, characterized in that the inlet means includes at least one tubing situated in a lower part of said at least one cylindrical mixer means.

15. A device according to claim 14, characterized in that said at least one tubing enters said at least one cylindrical mixer means tangentially.

16. A device according to claim 15, characterized in that each of said at least one cylindrical mixer means has between two and ten tubings entering therein.

* * * * *